US006586165B2

(12) United States Patent
Donovan et al.

(10) Patent No.: US 6,586,165 B2
(45) **Date of Patent: *Jul. 1, 2003**

(54) PHOTOGRAPHIC ELEMENTS COATED ON TRANSPARENT SUPPORT WITH REFLECTIVE PROTECTIVE OVERCOAT

(75) Inventors: Kevin M. Donovan, Bergen, NY (US); Glenn M. Brown, Rochester, NY (US); Lloyd A. Lobo, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/844,230

(22) Filed: Apr. 27, 2001

(65) Prior Publication Data

US 2003/0077546 A1 Apr. 24, 2003

(51) Int. Cl.[7] ..... G03C 1/795; G03C 1/76; G03C 1/815; G03C 11/06

(52) U.S. Cl. ..... 430/350; 430/496; 430/512; 430/523; 430/531; 430/536; 430/537; 430/539; 430/950

(58) Field of Search ..... 430/452, 531, 430/533, 535, 525, 538, 512, 631, 640, 517, 350, 496, 523, 536, 537, 539

(56) References Cited

U.S. PATENT DOCUMENTS 4,054,453 A * 10/1977 Grobin, Jr.
4,355,099 A 10/1982 Trautweiler
4,480,027 A 10/1984 Schone et al.
5,856,051 A 1/1999 Yau et al.
5,948,606 A 9/1999 Begel et al.
6,194,130 B1 2/2001 Nair et al.

FOREIGN PATENT DOCUMENTS

EP 1 193 544 A1 4/2002

OTHER PUBLICATIONS

Jones et al., "Protective Overcoat for Photographic Elements", U.S. patent application Ser. No. 09/621,267, filed Jul. 21, 2000.

* cited by examiner

*Primary Examiner*—Thorl Chea
(74) *Attorney, Agent, or Firm*—Chris P. Konkol

(57) ABSTRACT

The present invention is a photographic element which includes, in order, a transparent support, at least one silver halide emulsion layer superposed on the support, optionally a white or diffuse reflective layer, and a processing-solution-permeable protective layer on the backside, which protective layer becomes water-resistant in the final product without lamination or fusing. The present invention is also directed to a method of making a photographic print involving developing the photographic element. The resulting print is viewed through the support, which provides protection against scratches and stains, while the polymeric overcoat provides water and stain protection to the reverse of the print where minor scratches or damage are not critical, since the image is not viewed from this side. Thus, this invention provides for a tough, stain resistant and transparent viewing surface and a stain resistant back side, which is permeable to processing solutions.

18 Claims, 1 Drawing Sheet

PHOTOGRAPHIC ELEMENTS COATED ON TRANSPARENT SUPPORT WITH REFLECTIVE PROTECTIVE OVERCOAT

FIELD OF THE INVENTION

This invention provides for a photographic element having a tough, stain resistant and transparent viewing surface and a stain resistant back side which is permeable to processing solutions. In particular, the present invention results in a photographic print that is viewed through a transparent support that protects against scratches and stains. On the side of the photographic element opposite to the transparent support is a processing-solution-permeable overcoat that becomes water resistant in the photochemically processed product. In one embodiment, a separate white or diffuse layer between the overcoat and the imaging layers provides a suitable background for the image.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements, a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin or similar natural or synthetic hydrophilic polymers have proven to be the binders of choice for silver halide photographic elements. Unfortunately, when gelatin or similar polymers are formulated so as to facilitate contact between the silver halide crystals and aqueous processing solutions, the resultant coatings are not as fingerprint and stain resistant as would be desirable, particularly in view of the handling or environment that an imaged photographic element may commonly experience at various times and circumstances. Thus, fingerprints can permanently mark the imaged element. The imaged element can be easily stained by common household products, such as foods or beverages, for example, coffee spills.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. U.S. Pat. No. 5,376,434 describes a protective layer formed on a photographic print by coating and drying a latex on a gelatin-containing layer bearing an image.

Various lamination techniques are known and practiced in the trade. U.S. Pat. Nos. 3,397,980, 3,697,277 and 4,999,266 describe methods of laminating a polymeric sheet film, as a protective layer, on a processed image.

Protective coatings that need to be applied to the image after it is formed, whether by coating or by lamination, several of which were mentioned above, adds a significant cost to the final imaged product. The processing equipment needs to be modified and the personnel running the processing operation need to be trained to apply the protective coating. A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable. U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. Again, however, fusing is required by the photofinishing laboratories to render the protective overcoat water-resistant.

Commonly assigned U.S. Ser. No. 09/235,436 discloses the use of a processing solution permeable overcoat that is composed of a urethane-vinyl copolymer having acid functionalities. Commonly assigned U.S. Ser. Nos. 09/235,437 and 09/448,213 disclose the use of a second polymer such as a gelatin or polyvinyl alcohol to improve processibility and reduce coating defects. Commonly assigned U.S. Ser. No. 09/621,267 discloses the use of a processing solution permeable overcoat that is composed of a various water dispersed polymers that will coalesce into a water-resistant protective overcoat at elevated temperature, following processing, without fusing.

Thus, polymeric latex overcoats have been coated to provide protection to the image side of a print while allowing photographic development of the imaging layers. These overcoat layers, however, often fail to provide complete or desired protection. Specifically, they are prone to some damage during processing.

In conventional photographic elements for the production of color images to be viewed by reflected light ("color paper"), opaque support layers are traditionally used, e.g., paper which may be been rendered hydrophobic on one or both sides by a coating with polymers such as polyethylene. The opaque support layer generally provides the pale, preferably white, light-reflective image background for the image to be produced for viewing by reflected light. In contrast, U.S. Pat. No. 4,355,099 to Trautweiler discloses an imaging layer comprising a transparent support, imaging layers and a gelatin based protective layer. The photographic layers are exposed and the resulting images viewed through a transparent support layer while the processing liquids required for development enter the photographic layers from the active, coated side, and the imaging element is bonded to a main support after processing. To facilitate bonding of the material (the protective layer) to the main support, the transparent layer support is a thin auxiliary support not more than 50 $\mu$m in thickness. In one particular embodiment, a reflection layer may be placed above the photographic layers so that the image produced may be independent of the reflection characteristics of the main support. The photographic element of Trautweiler avoids some of the disadvantages of traditional gelatin overcoats, namely susceptibility to water and stain damage, mentioned above. One disadvantage of Trautweiler's imaging element is that the method employed for its processing necessarily includes bonding of the material to the main support, which is very cumbersome.

U.S. Pat. No. 4,480,027 to Schon et al. discloses an imaging element that has a transparent support, imaging layers and a reflective layer, in that order. The reflective layer has to be permeable to alkaline developing solutions. Although, it is not mandatory, the patent discloses that the reflective layer can be comprised of gelatin as the binder. Schon et al. conducted a stain test on the image side of the imaging element, which in this case is protected by the transparent support. Schon et al. did not perform a stain test on the reflective layer side.

The patents to Schon et al. and Trautweiler do not teach an imaging element that is processable and then stain resistant on both sides, unless lamination is done.

PROBLEM TO BE SOLVED BY THE INVENTION

Imaging elements have been overcoated with polymeric latex overcoats to provide protection to the image side of a print while allowing photographic development of the imaging layers. However, these overcoats are prone to some damage during processing, which can result in an objectionable appearance. Any scratches in the overcoat will be visible and may prevent the overcoat from protecting the image against stain or water resistance.

SUMMARY OF THE INVENTION

This invention provides for a photographic element having a tough, stain resistant and transparent viewing surface and a stain resistant backside which is permeable to processing solutions. The resulting photographic print is viewed through a transparent support that provides protection against scratches and stains. On the side of the photographic element opposite to the transparent support is a processing-solution-permeable protective coating that becomes water resistant in the photochemically processed product. The formulation for the protective coating comprises at least one water-dispersible polymer (or latex) interspersed with a water-soluble polymer. During development or thereafter, before drying, the water-soluble polymer is removed to a significant extent, facilitating coalescence of the residual water-dispersible polymer, thereby forming a water-resistant and stain-resistant continuous protective overcoat. Either the protective layer can provide an opaque background for the image, and/or a white or diffuse layer between the polymeric coating and the imaging layers can also be provided.

The polymeric coating provides water and stain protection to the reverse of the print where minor scratches or damage is not critical since the image is not viewed from this side. The transparent support which forms the viewing surface is tough, stain-proof, and can be wiped clean without potential damage. The back of the print is also rendered stain proof after the processing is completed. Minor blemishes that are intrinsic to these type of polymer films will not affect image quality, while maintaining print durability.

Another aspect of the invention provides for a method of forming an image in the imaging element described above and converting the overcoat into a water-resistant coating.

DESCRIPTION OF THE PREFERRED EMBODIMENTS

Figure 1:
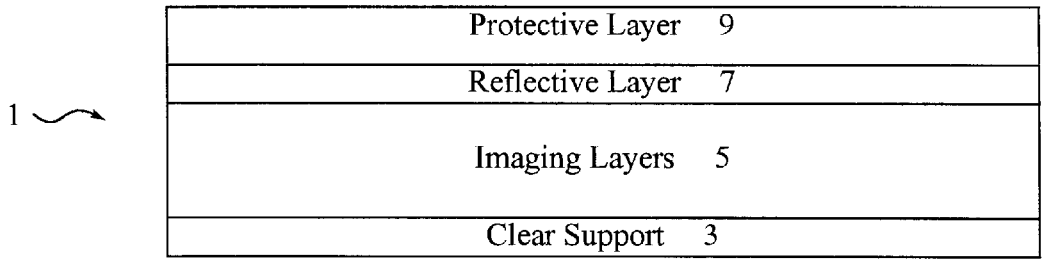
FIG. 1 is a cross-section through one embodiment of a photographic element in accordance with the invention, for use as an intermediate material in producing positive photographic prints.

The present invention provides a simple and inexpensive way to improve the water, stain and abrasion resistance of processed photographic elements.

By "front" or "front side" with respect to a photographic element is meant the side of the photographic element, before or after image capture or image development, through which the latent image is captured or through which developed image is viewed. Similarly, by "back" or "back side," with respect to a photographic element, is meant the side of the photographic element, before or after image capture or image development, remote from the side through which the latent image is captured or through which developed image is viewed.

By the term "water-resistant" is meant herein after ordinary. photoprocessing and drying does not imbibe water or prevents or minimizes water-based stains from discoloring the imaged side of the photographic element. By the term "non-crosslinked gelatin" is meant gelatin that is water soluble.

By the term "elevated temperature", as used in this application, to dry and/or facilitate coalescence of the water-dispersible polymer, is herein meant a temperature of from 30 to 80° C., preferably 45 to 60° C. In contrast, fusing typically requires a pressure roller or belt and drying of the imaged element before fusing. Fusing generally requires higher temperatures, typically above the boiling point of water, usually above 100° C.

By the term topcoat or overcoat, is meant the layer on the coated side of the support that is furthest from the support.

As mentioned above, this invention provides for a photographic element having a tough, stain resistant and transparent viewing surface and a stain resistant backside which is permeable to processing solutions. The resulting photographic print is viewed through a transparent support that provides protection against scratches and stains. On the side of the photographic element opposite to the transparent support is a processing-solution-permeable coating that becomes water resistant in the photochemically processed product. The overcoat formulation comprises at least one water-dispersible polymer (or latex) interspersed with a water-soluble polymer. During development or thereafter, before drying, the water-soluble polymer is removed to a significant extent, facilitating coalescence of the residual water-dispersible polymer, thereby forming a water-resistant and stain-resistant continuous protective coating. A white or diffuse layer between the polymeric coating and the imaging layers is preferably provided to effectively provide a Dmin for the image. However, the protective coating can also contain reflective particles to obviate the need for a separate reflective layer.

The advantages of the protective coating on the reverse side of the image are several. The polymeric overcoat provides water and stain protection to the reverse of the print where minor scratches or other superficial damage are not critical, since the image is not viewed from this side. In contrast, the transparent support which forms the viewing surface is tough, stain-proof, and even can be wiped by a wet cloth without potential damage. More effective cleaning agents can be used to clean the transparent support as compared to the traditional overcoat on an image. The back of the print is also rendered stain proof after the processing is completed. Minor blemishes that are intrinsic to these type of polymer films will not affect image quality, while maintaining print durability. Furthermore, because the protective overcoat does not need to be transparent, a wider choice of materials is possible, including hazy materials. The overcoat material can be more porous, and can include larger sized particles. Moreover, the protective overcoat, while providing stain and water resistance, is further used in combination with a reflective overcoat, such as titanium dioxide which provides additional protection. Minor abrasions, scratches, or scuffs are not viewable through the intermediate reflective layer, which further shields any imperfections or surface damage.

In accordance with one embodiment of the present invention, a protected print can be constructed by coating on a clear support the imaging pack followed by a white/reflective layer and a polymeric latex protective layer. Both the polymeric coating and the reflective layer would be capable of providing photochemical diffusion thus allowing formation of a print image. After photoprocessing, the polymeric layer provides stain and water protection to the reverse of the print. The print would be viewed through the clear support with that support offering substantial protection to the print surface (scuff, stain, washability, etc.) Thus, both sides of the print are protected from spill damage, while the front viewing side is better protected from physical damage like scratches.

In one embodiment of the invention, therefore, the photographic element comprises, in order, from front to back of the photographic element, a transparent support, at least one silver-halide emulsion layer superposed on the support, a white or diffuse reflective layer, and a processing-solution-permeable protective coating composition (preferably the topcoat for the backside of the photographic element) that does not inhibit photographic processing. Typically, the coating comprises polymer particles that are water-dispersible. The material of the invention can be introduced to the coating formulation in a latex form or as a conventional dispersion in a water soluble polymer which acts as a binder. The presence of a water soluble component that is substantially washed out during processing allows photographic processing to proceed at an acceptable rate. The washing out of the water soluble component facilitates the coalescence of the water-dispersible materials in the final product, further facilitated by elevated temperatures commonly associated with drying.

In one embodiment of the invention, the coating composition for the protective layer applied to backside the imaging element comprises 30 to 95 weight percent, based on the dry laydown of the overcoat, of water-dispersible polymer particles having an average of between 0.01 to 1 dispersible polymer being characterized by a $T_g$ (glass transition temperature) of between −40 and 80° C.

In another embodiment of the invention, a photographic element comprises, from front to back: (a) a transparent support; (b) at least one silver-halide emulsion layer superposed on a side of said support; and overlying the silver emulsion layer, (c) a white reflective layer comprising particles or pigments with a refractive index different from the binder, such that most of the light incident upon it is reflected., (d) a processing-solution-permeable protective topcoat having a laydown of at least 0.54 g/m$^2$(50 mg/ft$^2$) made from an overcoat formulation that is substantially gelatin-free, comprising less than 5% crosslinked gelatin by weight of solids. In general, the overcoat composition preferably contains a water-soluble, hydrophilic polymer that is typically noncrosslinked to facilitate its washing out during processing and, at least to some extent, to facilitate the coalescence of the water-dispersible polymer particles. In one embodiment, the reflective layer comprises either reflective particles or hollow or voided spheres. In a preferred embodiment, the reflective layer comprises titanium dioxide in gelatin. The reflective layer, alone or in combination with the protective topcoat, should provide effective opacity and whiteness to form the background to the formed/developed image.

In another embodiment of the invention, the applied backside topcoat composition comprises about of 30 to 95% by weight of solids of water-dispersible polymer particle having an average particle size of less than 10 $\mu$m and a $T_g$ between 40° C. and 80° C., and 5 to 70% by weight of solids of water-soluble hydrophilic polymer such that more than 30 weight percent of the water-soluble polymer is washed out during photographic processing; wherein the weight ratio of the water dispersible hydrophobic polymer particles to the non-crosslinked water soluble polymer is between 60:40 to 85:15 and whereby the overcoat forms a water-resistant overcoat after photoprocessing without fusing. The overcoat can have additional particles to contribute to the Dmin, opacity, and whiteness, for example, reflective particles.

As mentioned above, the topcoat forming the protective layer on the backside of the photographic element can be opaque, translucent, or transparent and, if appropriately designed, can minimize or eliminate the need for a separate reflective layer.

With respect to 30 weight percent of the water-soluble polymer being capable of being washed out, this can be measured with respect to any conventional RA4 photographic processing, for example, the KODAK RA4 process. The "RA" in the term RA4 refers to rapid access processing, as indicated by the attached pages 438 and 460 of the *Handbook of Photographic Science and Engineering*. The number, in this case "4," in the term RA4 refers to a time period for processing. RA4 processing is commonly used in minilabs in the US and around the world. RA4 processing is uniform to the extent that, in general, any photographic paper designed for any RA4 processing can be processed anywhere in the world according in any RA4 process and the result will be satisfactory.

In one embodiment, a reflective layer comprises either reflective particles or hollow or voided spheres. In a preferred embodiment, the reflective layer comprises titanium dioxide in gelatin. Referring to FIG. 1, a section of a composite photographic imaging element 1 is shown comprising a transparent support 3, a number of photographic emulsions or imaging layers 5 (optionally comprising color unit layers) which together with any other auxiliary layers for image production constitute the photosensitive material, a reflective base or layer 7, which may be white-pigmented, and a protective layer 9. The reflective layer is intended to provide background opacity and whiteness for an image formed in by emulsion layers. In any case, the combined light reflectance of the reflective layer and the protective layer is greater than 80%, preferably greater than 90%.

Figure 2:
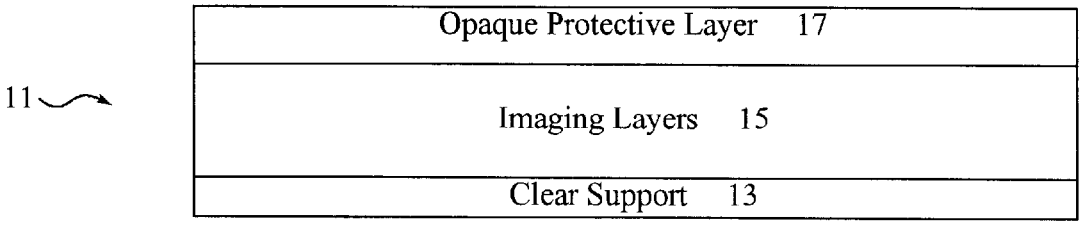
FIG. 2 is a cross-section through a second embodiment of a photographic element in accordance with the invention, for use as an intermediate material in producing positive photographic prints, in which there is no separate reflective layer.

In the embodiment of FIG. 2, a section of a composite photographic imaging element 11 is shown comprising a transparent or clear support 13, a number of photographic emulsions or imaging layers 15, which together with any other auxiliary layers for image production constitute the photosensitive material layer. In this embodiment, a polymeric protective layer 17 is opaque and white-pigmented. In this case, the light reflectance of the protective layer alone is greater than 80%, preferably greater than 90%. In this embodiment, therefore, a separate reflective layer or layers is unnecessary.

Preferably the transparent support for the color photographic element according to the invention is a stain-resistant, non-porous, water-impermeable transparent material having a thickness of 60 to 250 μm, preferably 70 to 200 μm, more preferably 80 to 150 μm. If the thickness of the support is too small, the strength may be too low and it may be prone to penetration by scratches. The transparent support layer may consist of any of the usual transparent support materials used in photographic practice, e.g. films of cellulose esters, polyethylene terephthalate, PEN, acetate, polycarbonates or other film forming polymers. Since the transparent support layers used in the photographic element according to the invention also function as the main support layers, they must have sufficient rigidity and dimensional stability, preferably exhibiting a bending stiffness between 50 and 250 millinewtons. The bending stiffness is measured using the LORENTZEN & WETTRE STIFFNESS TESTER, MODEL 16D. The output from this instrument is the force, in millinewtons, required to bend the cantilevered, unclamped end of a sample 20 mm long and 38.1 mm wide at an angle of 15 degrees from the unloaded position. This condition is generally fulfilled by using the usual transparent layer supports with thicknesses of 60 μm and upwards. However, the particular thickness used in any individual case depending mainly on the nature of the support material and its optical properties. Thicknesses above 90 μm, for example, provide satisfactory results when using cellulose triacetate foil while thicknesses above 70 μm are most suitable when using polyethylene terephthalate foil. A preferred material for the transparent support is PET or PEN.

Another important characteristic of the support layer apart from its supporting characteristics is that it should have sufficient transparency. Since the color images produced with the imaging element according to the invention are required to be viewed through the support layer, the support must be optically clear and permit unhindered viewing of the color image from various directions. In particular, every image point should be visible to both eyes of an observer from every viewing angle below the critical angle of total reflection. To improve the stability to light of the imaging element according to the invention, the layer support or a transparent auxiliary layer applied to it may be equipped with a UV absorbent in known manner. The transparent support may be embossed to provide a preselected smoothness or gloss, including matte surfaces or other desirable surface types and characteristics. Thus, a highly smooth transparent support will give a glossy surface to the imaged element, a textured surface will give a matte or otherwise textured surface to the element, etc.

The transparent support can comprise a UV absorber incorporated into the polymer material to provide UV absorption, thus protecting the image from UV induced fading. Other possible additives include biocides, lubricants, pigments, and the like.

The light sensitive element of the photographic element according to the invention contains at least one silver halide emulsion layer and at least one color coupler associated with this silver halide emulsion layer, as described in further detail below. The term "associated" means that the spatial arrangement of silver halide emulsion layer and color coupler is such that they are capable of interacting in the course of chromogenic development in such a manner as to provide for image-wise correspondence between the silver image formed in the course of color development and the image-wise distribution of the chromogenically produced dye. The color coupler need not necessarily be present in the light sensitive silver halide emulsion layer for this purpose but may equally well be present in a light insensitive layer of binder adjacent to the silver halide emulsion layer. Typically, the color photographic element according to the invention generally contains at least three silver halide emulsion layers differing in their spectral sensitivity and color couplers associated with them, the term "associated" being used also to include the relationship between the spectral sensitivity of the silver halide emulsion layer and the color of the dye produced from the associated color coupler by chromogenic development. Generally, the color of the image dye is complementary to the color of the light recorded in the associated silver halide emulsion layer. The various silver halide emulsion layers of different spectral sensitivities need not necessarily be arranged in any particular sequence, the arrangement depending on the particular requirements and characteristics (e.g. development kinetics) of the individual layers. Thus the red sensitized silver halide emulsion layer, for example, may be arranged directly adjacent to the transparent support layer or as the furthest removed silver halide emulsion layer, i.e. directly adjacent to the light reflective opaque layer. The same also applies to the other emulsion layers.

As mentioned above, a reflective layer can comprise either reflective particles or hollow or voided spheres. In a preferred embodiment, the reflective layer comprises titanium dioxide in gelatin. The reflective layer, alone or in combination with the protective overcoat, should provide effective opacity, reflectance, and whiteness for the image. The light-reflective, opaque layer (as in FIG. 1) is arranged below the light-sensitive imaging layers. This light-reflective, opaque layer must be permeable to aqueous alkaline solutions. Its main function is to provide an aesthetically pleasing background to the color image produced in the light-sensitive element. This background may be obtained in known manner by means of a layer binder containing a light pigment, in particular a white pigment, e.g. $TiO_2$ or $BaSO_4$. Suitable for this purpose, for example, is a gelatin-containing layer of binder containing from 1 to 50 g $TiO_2$ per $m^2$. The reflecting power of the finished image is advantageously adapted to specific requirements by the incorporation of a white pigment or some other reflecting material. In addition to titanium dioxide and barium sulfate, other white pigments are possible such as zinc oxide, zinc sulphide, lithopone, zirconium oxide, lead sulphate, lead carbonate, and so on.

A reflective layer is preferably used for effectively providing photographic quality whiteness to the formed image. The reflective layer is typically closest to the imaging layer of the imaging element in relation to their function of providing whiteness.

The entire underlayer (including the protective layer, in the absence or presence of a separate reflective layer) preferably provides a light reflectance (at the interface with the overlying imaging layer) of greater than 80%, preferably greater than 90%, most preferably greater than 95%.

To evaluate the whiteness of the opaque support below the imaging layers, a HUNTER spectrophotometer CIE system D65 procedure can be employed to measure the L Star UVO (ultraviolet filter out). In this test a control sample consisting of a standard color photographic paper can be used to compare the results. L Star UVO values of 92.95, for example, are considered typical. The opacity of the opaque support can also be measured by the HUNTER spectrophotometer CIE system D65. Opacity is a measure of combined light scattering and absorbing power of a specimen. The HUNTER spectrophotometer has a known light source that is transmitted onto the surface of a sample backed by a white reflective tile and a black absorbant tile and indicates the diffuseness or hiding power. A value of 100% would mean that nothing is absorbed and only reflected light is measured.

The photographic imaging element may also contain additional auxiliary layers and ingredients as discussed below.

The arrangement of imaging layers is conventionally arranged in the order of cyan, magenta and yellow, which is at present regarded as optimal for photographic reasons, but can be altered to provide for improved developability (sensitivity) of yellow. The arrangement of layers according to the invention also allows the incorporation of additives which in spite of their photographic effectiveness cannot be used in conventional imaging elements on account of their insufficient transparency or their self-color or other disturbing factors. Such additives include anti-oxidants, developers, anti-static agents, stabilizers for high temperature processing, substances which seal the imaging element by rendering it hydrophobic by reactions either during or after processing, or micro-capsules containing photographically-active substances. Such additives may be incorporated in layers which are not photographically active in the imaging element according to the invention, e.g. in particular in a layer of binder arranged on that side of the light reflective, opaque layer which is remote from the transparent layer support.

The present invention provides an improved overcoat formulation for the imaging side of an imaging element or material, including photographic prints, which encounter frequent handling and abuse by end users. In one embodiment, a water-resistant layer is facilitated by coalescing the residual water-dispersible polymer material in the imaging element at a temperature sufficiently high, preferably during the drying step, after the photographic material has been photochemically processed. The use of less than 5% by weight of crosslinked gelatin or other crosslinked hydrophilic polymer in the overcoat (as applied) is sufficient to allow proper coalescence of during such a drying step. It is noted that some gelatin from underlying layers in the photographic element may migrate into the overcoat, during manufacture or photochemical processing, for example, but any such migration is limited and, by definition, is not included in the composition formulation or in the applied overcoat. In one embodiment, less than 5%, more preferably less than 3%, by weight of solids, of gelatin is included in the overcoat composition. Most preferably, essentially no gelatin is included in the overcoat formulation. In one embodiment, however, crosslinkable gelatin is applied over the emulsion layer, which becomes crosslinked during manufacture of the photographic element, but becomes digested and converted to substantially non-crosslinked gelatin in the final product, in which at least 95% of the gelatin water soluble.

The dispersions of polymers particles used in this invention are latexes or polymers of any composition that can be stabilized in an water-based medium. Such polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins and halogenated olefins, unsaturated acids and esters derived form them, unsaturated nitriles, acrylamides and methacrylamides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization. The selection of water-dispersible particles to be used in the overcoat is based on the material properties one wishes to have as the protective overcoat in addition to water resistance.

The water-dispersible polymer is selected, preferably, so that fusing is not required, a potentially significant advantage compared to the prior art, for example U.S. Pat. No. 5,856,051, mentioned above. It has been found that once the water soluble polymer is removed (which may optionally involve being first hydrolyzed and degraded by proteolytic enzyme) and removed during photographic processing (including optional additional washing), the selected water-dispersible particles will coalesce without fusing (which they would not do in the presence of substantial amounts of crosslinked gelatin or the like).

In a preferred embodiment of the invention, the water-dispersible polymer is a substantially amorphous, thermoplastic polymer having ionized or ionizable groups or moieties in sufficient number to provide water dispersibility prior to coating. In addition to water-resistance, the polymer dispersions in the finally processed product preferably provides further advantageous properties such as good chemical and stain resistance, wet-abrasion resistance, fingerprint resistance, toughness, elasticity, durability, and/or resistance to various oils.

In the case of carboxylic acid ionic groups, the polymer can be characterized by the acid number, which is preferably greater than or equal to 5 and relatively permeable to water at a pH of greater than 7. Preferably, the acid number is less than or equal to 40, more preferably less than or equal to 30. Preferably, the pH of the developing solution is greater than 8, preferably greater than 9. The water-reducible water-dispersible polymer particles comprising ionized or ionizable groups may be branched, unbranched, crosslinked, uncross linked.

In accordance with this invention, the protective overcoat preferably comprises, in addition to the water-dispersible polymer described above, at least one water-soluble hydrophilic polymer. Examples of such water-soluble polymers that may be added include polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly(methacrylic acid), poly (oxymethylene), poly(ethyleneimine), poly(ethylene glycol methacrylate), poly(hydroxy-ethyl methacrylate), poly (vinyl methyl ether), poly(styrene sulfonic acid), poly (ethylene sulfonic acid), poly(vinyl phosphoric acid) and poly(maleic acid) and the like. Such materials are included in "Handbook of Water-Soluble Gums and Resins" by Robert l. Davidson (McGraw-Hill Book Company, 1980) or "Organic Colloids" by Bruno Jirgensons (Elsvier Publishing Company, 1958). In a preferred embodiment, the polymer is polyvinyl alcohol, which polymer has been found to yield coatings that are relatively uniform and to enhance the diffusion rate of the developer into the underlying emulsions.

The preferred water soluble hydrophilic polymer is polyvinyl alcohol. The term "polyvinyl alcohol" referred to herein means a polymer having a monomer unit of vinyl alcohol as a main component. Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, "World of PVA", Edited by the Poval Society and Published by Kobunshi Kankoukai, Japan, 1992 and "Poval", Edited by Nagano et al. and Published by Kobunshi Kankoukai, Japan, 1981). The degree of hydrolysis (or saponification) in the polyvinyl alcohol is preferably at least about 70% or more, more preferably at least about 80%. Percent hydrolysis refers to mole percent. For example, a degree of hydrolysis of 90% refers to polymers in which 90 mol % of all copolymerized monomer units of the polymer are vinyl alcohol units. The remainder of all monomer units consists of monomer units such as ethylene, vinyl acetate, vinyl trifluoroacetate and other comonomer units which are known for such copolymers. Most preferably, the polyvinyl alcohol has a weight average molecular weight (MW) of less than 150,000, preferably less than 100,000, and a degree of hydrolysis greater than 70%. If the MW is greater than 100,000, the degree of hydrolysis is preferably less than 95%. Preferably, the degree of hydrolysis is 85 to 90% for a polyvinyl alcohol having a weight average MW of 25,000 to 75,000. These preferred limitations may provide improved manufacturability and processibility. The polyvinyl alcohol is selected to make the coating wettable, readily processable, and in a substantial amount, to readily, not sluggishly, come out of the coating during processing, thereby yielding the final water-resistant product. The optimal amount of polyvinyl alcohol depends on the amount of dry coverage of water-dispersible polymer. In one preferred embodiment of the invention, the polyvinyl alcohol is present in the overcoat in the amount between 1 and 60 weight percent of the water-dispersible polymer, preferably between 5 and 50 weight percent of the water-dispersible polymer, most preferably between 10 and 45 weight percent of the water-dispersible polymer.

Without being bound by theory, it is believed that the water-soluble polymer and water-dispersible polymer form a compatible mixture, which allows the formation of a water-resistant overcoat that does not require fusing, merely elevated temperatures preferably up to about 60° C. It is believed that fusing is not required for several reasons: (a) the substantial absence of cross-linked gelatin and other such crosslinked polymers, and (b) the selection of a water-dispersible polymer that is believed to form a compatible mixture with the hydrophilic water-soluble polymer, c) the selection of the water soluble polymer which is believed to be removed during processing such that the water dispersible polymer coalesces to forms a water-resistant overcoat.

Optionally, the coating composition in accordance with the invention may also contain suitable crosslinking agents for crosslinking the water-dispersible polymer. Such an additive can improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered. If a crosslinker is added, care must be taken that excessive amounts are not used as this will decrease the permeability of the processing solution. The crosslinker may be added to the mixture of water-dispersible component and any additional polymers.

The optimal amount of the water-soluble polymer may depend on the amount of dry coverage of water-dispersible polymer. For example, in the case of the combination of a polyurethane polymer and a polyvinyl alcohol polymer, if coverage of a polyurethane polymer is 1.08 g/m$^2$ (100 mg/ft$^2$) or less, then about 20% or less of polyvinyl alcohol, by weight of the polyurethane, provides good results, whereas for higher coverage, for example (1.88 g/m$^2$) 175 mg/ft$^2$, greater than about 25% of the polyvinyl alcohol provides comparably good results.

In one preferred embodiment, the water-dispersible polymer of this invention are polyurethanes, preferably segmented polyurethanes. Polyurethanes are the polymerization reaction product of a mixture comprising polyol monomers and polyisocyanate monomers.

A preferred segmented polyurethane is described schematically by the following structure (I):

Structure I

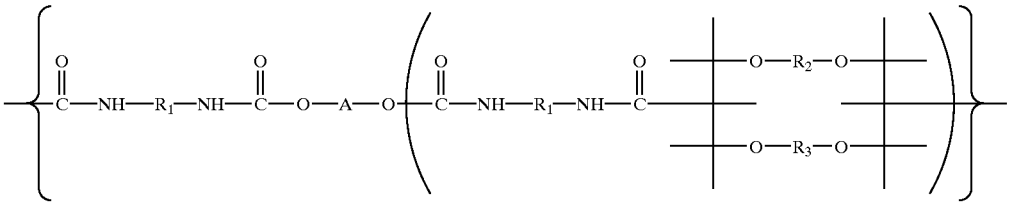

wherein $R_1$ is preferably a hydrocarbon group having a valence of two, more preferably containing a substituted or unsubstituted, cyclic or non-cyclic, aliphatic or aromatic group, most preferably represented by one or more of the following structures:

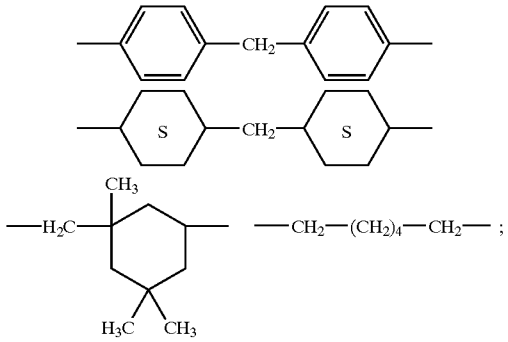

and wherein

A represents a polyol, such as a) a dihydroxy polyester obtained by esterification of a dicarboxylic acid such as succinic acid, adipic acid, suberic acid, azelaic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl propane-1,3-diol, or the various isomeric bis-hydroxymethylcyclohexanes; b) a polylactone such as polymers of ϵ-caprolactone and one of the above mentioned diols; c) a polycarbonate obtained, for example, by reacting one of the above-mentioned diols with diaryl carbonates or phosgene, or d) a polyether such as a polymer or copolymer of styrene oxide, propylene oxide, tetrahydrofuran, butylene oxide or epichlorohydrin;

$R_3$ is a phosphonate, carboxylate or sulfonate group, and $R_2$ is a diamine or diol having a molecular weight less than about 500. Suitable well known diamine chain extenders useful herein include ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, ethylene methylenebis(2-chloroaniline), 3,3'-dichloro-4,4'-biphenyl diamine. 2,6-diaminopyridine, 4,4'-diamino diphenylmethane, and adducts of diethylene triamine with acrylate or its hydrolyzed products. Also included are materials such as hydrazine, substituted hydrazines such as, for example, dimethyl hydrazine, 1,6-hexamethylene-bis-hydrazine, carbodihydrazide, hydrazides of dicarboxylic acids and sulfonic acids such as adipic acid mono- or dihydrazide, oxalic acid dihydrazide, isophthalic acid dihydrazide, tartaric acid dihydrazide, 1,3-phenylene disulfonic acid dihydrazide, omega-amino-caproic acid dihydrazide, hydrazides made by reacting lactones with hydrazine such as gamma-hydroxylbutyric hydrazide, bis-semicarbazide, bis-hydrazide carbonic esters of glycols such as any of the glycols mentioned above. Suitable well known diol chain extenders may be any of the glycols or diols listed above for A. $R_3$ is a phosphonate, carboxylate or sulfonate group.

The number of repeating units of Structure I can range from 2 to 200, preferably 20 to 100. The amount of the hard-segment (in the right-hand parenthesis)is preferably 40 to 70 percent by weight. The weight ratio of the $OR_3O$ to the $OR_2O$ repeating unit preferably varies from 0 to 0.1. The water-dispersible polyurethane employed in the invention may be prepared as described in "Polyurethane Handbook," Hanser Publishers, Munich Vienna, 1985.

The term "polyurethane", as used herein, includes branched and unbranched copolymers, as well as IPN and semi-IPNs comprising at least two polymers, at least one of which is a polyurethane.

An IPN is an intimate combination of two or two or more polymers in a network, involving essentially(that may essentially involve) no covalent bonds or grafts between them. Instead, these intimate mixtures of polymers are held together by permanent entanglements produced when at least one of the polymers is synthesized in the presence of the other. Since there is usually molecular interpenetration of the polymers in IPNs, they tend to phase separate less compared to blends. Such interpenetrating polymer network systems and developments are described by L. H. Sperling in "Interpenetrating Polymer Networks and Related Materials," Plenum Press, New York, 1981, in pages 21–56 of "Multicomponent Polymer Materials" ACS Adv. In Chem. No. 211, edited by D. R. Paul and L. H. Sperling, ACS Books, Washington, D.C., 1986, and in pages 423–436 of "Comprehensive Polymer Science", Volume 6, "Polymer Reactions", edited by G. C. Eastmond, A. Ledwith, S. Russo, and P. Sigwalt, Pergamon Press, Elmsford, N.Y., 1989. While an ideal structure may involve optimal interpenetration, it is recognized that in practice phase separation may limit actual molecular interpenetration. Thus, an IPN may be described as having "interpenetrating phases" and/or "interpenetrating networks." If the synthesis or crosslinking of two or more of the constituent components is concurrent, the system may be designated a simultaneous interpenetrating network. If on the other hand, the synthesis and/or crosslinking are carried out separately, the system may be designated a sequential interpenetrating polymer network. A polymer system comprising two or more constituent polymers in intimate contact, wherein at least one is crosslinked and at least one other is linear is designated a semi-interpenetrating polymer network. For example, this type of polymer system has been formed in cured photopolymerizable systems such as disclosed in Chapter 7 of "Imaging Processes and Materials-Neblette's Eighth Edition," edited by J. M. Sturge, V. Walworth & A. Shepp, Van Nostrand Reinhold, New York, 1989.

In one embodiment of the present invention, the water-dispersible polymer is a polyurethane containing pH responsive groups such as acid functionalities and have an acid number greater than or equal to 5, preferably less than or equal to 40, more preferably less than or equal to 30, most preferably from 10 to 25. The weight ratio of the optional vinyl polymer in the polymer can vary from 0 to 80 percent, including a interpenetrating network of a urethane polymer and a vinyl polymer if the amount of vinyl polymer is substantially greater than zero.

In another embodiment of the present invention, the water-dispersible polymer is a polyurethane-containing component that is an IPN or semi-IPN comprising a polyurethane and a vinyl polymer. By the term "vinyl polymer" is meant an addition polymer that is the reaction product of ethylenically unsaturated monomers. Particularly preferred vinyl polymers are acrylics. Vinyls, especially acrylics, have the added advantage of good adhesion, non-yellowing, are adjustable for high gloss, and have a wide range of glass transition and minimum film forming temperatures. Polymerization of vinyl monomers in the presence of the polyurethane copolymer causes the two polymers to reside in the same latex particle as an interpenetrating or semi-interpenetrating network particle resulting in improved resistance to water, organic solvents and environmental conditions, improved tensile strength, and modulus of elasticity. The presence of groups such as carboxylic acid groups provide a conduit for processing solutions to permeate the coating at pH greater than 7. Preferably, the acid number is maintained at less than or equal to 40 to ensure that overcoat has good adhesion to the substrate below, even at high pH, and makes the overcoat more water-resistant.

A preferred IPN comprises an interpenetrating polyurethane and vinyl polymer. Such an IPN is also sometimes referred to in the trade as a urethane-vinyl copolymer or hybrid copolymer, even though involving essentially no chemical bonds between the two polymer chains. Such an IPN may be conventionally produced by polymerizing one or more vinyl monomers in the presence of the polyurethane prepolymer or a chain extended polyurethane. It is possible to have more than two polymers or for each of the polymer chains to be branched or linear. Suitably, in such an IPN, the weight ratio of polyurethane component to vinyl component is 1:20 to 20:1. The preferred weight ratio of the polyurethane to the vinyl component is about 4:1 to about 1:4, more preferably about 1:1 to 1:4.

Preferably, the polyurethane has an acid number of greater than or equal to 5, preferably less than or equal to 40, more preferably less than or equal to 30. Acid number is in general determined by titration and is defined as the number of milligrams of potassium hydroxide (KOH) required to neutralize 1 gram of the polymer.

Preparation of an aqueous dispersion of a polyurethane-containing component, when a single copolymer, is well known in the art. In a preferred method of preparation, the first step is the formation of a medium molecular weight isocyanate terminated prepolymer by the reaction of suitable di or polyol with a stoichiometric excess of di or polyisocyanates. The prepolymer is then generally dispersed in water via water-solubilizing/dispersing groups that are introduced either into the prepolymer prior to chain extension, or are introduced as part of the chain extension agent. Therefore, small particle size stable dispersions can frequently be produced without the use of an externally added surfactant. The prepolymer in the aqueous solution is then subjected to chain extension using diamines or diols to form the "fully reacted" polyurethane.

When a vinyl polymer is present in the polyurethane-containing component, such urethane-vinyl IPN copolymers may be produced, for example, by polymerizing one or more vinyl monomers in the presence of the polyurethane prepolymer or the chain extended polyurethane. The preferred weight ratio of the chain extended polyurethane to the vinyl monomer being about 4:1 to about 1:4, most preferably about 1:1 to 1:4, as mentioned above.

Polyols useful for the preparation of polyurethane dispersions of the present invention include polyester polyols prepared from one or more diols (e.g. ethylene glycol, butylene glycol, neopentyl glycol, hexane diol or mixtures of any of the above) and one or more dicarboxylic acids or anhydrides (succinic acid, adipic acid, suberic acid, azelaic acid, sebacic acid, phthalic acid, isophthalic acid, maleic acid and anhydrides of these acids), polylactone diols prepared from lactones such as caprolactone reacted with a diol, polyesteramides containing polyols prepared by inclusion of amino-alcohols such as ethanol amine during the polyesterification process, polyether polyols prepared from for example, ethylene oxide, propylene oxide or tetrahydrofuran, polycarbonate polyols prepared from reacting diols with diaryl carbonates, and hydroxyl terminated polyolefins prepared from ethylenically unsaturated monomers. Combinations of such polyols are also useful. As mentioned below, polysiloxane polyols are also useful in forming a polyurethane. See, for example, U.S. Pat. No. 5,876,9810 to Anderson, hereby incorporated by reference, for such monomers. A polyester polyol is preferred for the present invention.

Polyisocyanates useful for making the prepolymer may be aliphatic, aromatic or araliphatic. Examples of suitable polyisocyanates include one or more of the following: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cyclopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'-diisocyanatodiphenyl ether, tetramethyl xylene diisocyanate, polymethylene polyphenyl polyisocyanates and the like. Methylene bis(isocyanato cyclohexane) is preferred.

Preferably, a suitable portion of the prepolymer also contains at least one comparatively unreactive pendant carboxylic group, in salt form or preferably neutralized with a suitable basic material to form a salt during or after prepolymer formation or during formation of the dispersion. This helps provide permeability of processing solutions through the overcoat at pHs greater than 7 and dispersibility in water. Suitable compounds that are reactive with the isocyanate groups and have a group capable of forming an anion include, but are not limited to the following: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like. Such a carboxylic-containing reactant is preferably an $\alpha,\alpha$-dimethylolalkanoic acid, especially 2,2-dimethylol propionic acid.

Suitable tertiary amines which may be used to neutralize the acid and form anionic groups for water dispersability are trimethylamine, triethylamine, dimethylaniline, diethylaniline, triphenylamine and the like.

Chain extenders suitable for optionally chain extending the prepolymer are, for example, active-hydrogen containing molecules such as polyols, amino alcohols, ammonia, primary or secondary aliphatic, aromatic, alicyclic araliphatic or heterocyclic amines especially diamines. Diamines suitable for chain extension of the prepolyurethane include ethylenediamine, diaminopropane, hexamethylene diamine, hydrazine, aminoethyl ethanolamine and the like.

In accordance with one embodiment of this invention, a urethane-vinyl IPN may be prepared by polymerizing vinyl addition monomers in the presence of the polyurethane prepolymer or the chain extended polyurethane. The solution of the water-dispersible polyurethane prepolymer in vinyl monomer may be produced by dissolving the prepolymer in one or more vinyl monomers before dispersing the prepolymer in water.

Suitable vinyl monomers in which the prepolymer may be dissolved contain one or more polymerizable ethylenically unsaturated groups. Preferred monomers are liquid under the temperature conditions of prepolymer formation, although the possibility of using solid monomers in conjunction with organic solvents is not excluded.

The vinyl polymers useful for the present invention include those obtained by copolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

The prepolymer/vinyl monomer solution may be dispersed in water using techniques well known in the art. Preferably, the solution is added to water with agitation or, alternatively, water may be stirred into the solution. Polymerization of the vinyl monomer or monomers is brought about by free radical initiators at elevated temperatures.

Free radicals of any sort may be used including persulfates (such as ammonium persulfate, potassium persulfate, etc., peroxides (such as hydrogen peroxide, benzoyl peroxide, cumene hydroperoxide, tertiary butyl peroxide, etc.), azo compounds (such as azobiscyanovaleric acid, azoisobutyronitrile, etc.), and redox initiators (such as hydrogen peroxide-iron(II) salt, potassium persulfate-sodium hydrogen sulfate, etc.). Preferable free radical initiators are the ones that partition preferably into the oil phase such as the azo-type initiators. Common chain transfer agents or mixtures thereof known in the art, such as alkylmercaptans, can be used to control the polymer molecular weight.

Polymerization may be carried out by various methods. In one method, all of the vinyl monomer (the same or different vinyl monomers or monomer mixtures) is added in order to swell the polyurethane prepolymer. The monomers are then polymerized using an oil soluble free radical initiator after dispersing the mixture in water.

In a second alternative method, some of vinyl monomer may be added to swell the pre-polymer prior to dispersing in water. The rest of the monomer is fed into the system during the polymerization process. Other methods include feeding in all the vinyl monomer during the copolymerization process.

Some examples of polyurethane-containing components used in the practice of this invention that are commercially available include NeoPac® R-9000, R-9699 and R-9030 Avecia, Sancure® AU4010 from BF Goodrich (Akron, Ohio), and Flexthane® 620, 630, 790 and 791 from Air Products. An example of the polyurethane-containing copolymer useful in the practice that is commercially available is the NeoRez® R9679.

In another embodiment of the invention, the water-dispersible polymer is an essentially substantially amorphous, thermoplastic polyester polymer in which ionic groups or moieties are present in sufficient number to provide water dispersibility prior to coating. The polyester dispersions provide advantageous properties such as good film-formation, good chemical-resistance, wet-abrasion resistance, excellent fingerprint resistance, toughness, elasticity and durability. Furthermore, the polyesters exhibit tensile and flexural strength and resistance to various oils.

Procedures for the preparation of polyester ionomers are described in U.S. Pat. Nos. 3,018,272; 3,563,942; 3,734,874; 3,779,993; 3,929,489; 4,307,174, 4,395,475, 5,939,355 and 3,929,489, the disclosures of which are incorporated herein by reference. The substantially amorphous polyesters useful in this invention comprise dicarboxylic acid recurring units typically derived from dicarboxylic acids or their functional equivalents and diol recurring units typically derived from diols. Generally, such polyesters are prepared by reacting one or more diols with one or more dicarboxylic acids or their functional equivalents (e.g. anhydrides, diesters or diacid halides), as described in detail in the cited patents. Such diols, dicarboxylic acids and their functional equivalents are sometimes referred to in the art as polymer precursors. It should be noted that, as known in the art, carbonylimino groups can be used as linking groups rather than carbonyloxy groups. This modification is readily achieved by reacting one or more diamines or amino alcohols with one or more dicarboxylic acids or their functional equivalents. Mixtures of diols and diamines can be used if desired.

Conditions for preparing the polyesters useful in this invention are known in the art as described above. The polymer precursors are typically condensed in a ratio of at least 1 mole of diol for each mole of dicarboxylic acid in the presence of a suitable catalyst at a temperature of from about 125° to about 300° C. Condensation pressure is typically from about 0.1 mm Hg to about one or more atmospheres. Low-molecular weight by-products can be removed during condensation, e.g. by distillation or another suitable technique. The resulting condensation polymer is polycondensed under appropriate conditions to form a polyester. Polycondensation is usually carried out at a temperature of from about 150° to about 300° C. and a pressure very near vacuum, although higher pressures can be used.

Polyester ionomers, useful in the present composition, contain at least one ionic moiety, which can also be referred to as an ionic group, functionality, or radical. In a preferred embodiment of the invention, the recurring units containing ionic groups are present in the polyester ionomer in an amount of from about 1 to about 12 mole percent, based on the total moles of recurring units. Such ionic moieties can be provided by either ionic diol recurring units and/or ionic dicarboxylic acid recurring units, but preferably by the latter. Such ionic moieties can be anionic or cationic in nature, but preferably, they are anionic. Exemplary anionic ionic groups include carboxylic acid, sulfonic acid, and disulfonylimino and their salts and others known to a worker of ordinary skill in the art. Sulfonic acid ionic groups, or salts thereof, are preferred.

One type of ionic acid component has the structure

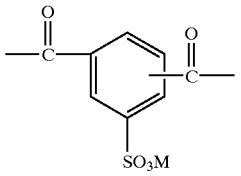

where M=H, Na, K or $NH_4$.

Ionic dicarboxylic acid recurring units can be derived from 5-sodiosulfobenzene-1,3-dicarboxylic acid, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Specification No. 1,470,059 (published Apr. 14, 1977). Other suitable polyester ionomers for protective overcoats in the imaged elements of the present invention are disclosed in U.S. Pat. Nos. 4,903,039 and 4,903,040, which are incorporated herein by reference.

Another type of ionic dicarboxylic acid found useful in the practice of this invention are those having units represented by the formula:

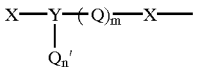

wherein each of m and n is 0 or 1 and the sum of m and n is 1; each X is carbonyl, Q has the formula:

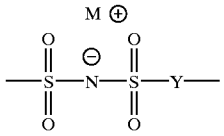

Q' has the formula:

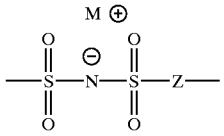

Y is a divalent aromatic radical, such as arylene (e.g. phenylene, naphthalene, xylylene, etc.) or arylidyne (e.g. phenenyl, naphthylidyne, etc.); Z is a monovalent aromatic radical, such as aryl, aralkyl or alkaryl (e.g. phenyl, p-methylphenyl, naphthyl, etc.), or alkyl having from 1 to 12 carbon atoms, such as methyl, ethyl, isopropyl, n-pentyl, neopentyl, 2-chlorohexyl, etc., and preferably from 1 to 6 carbon atoms; and M is a solubilizing cation and preferably a monovalent cation such as an alkali metal or ammonium cation.

The protective layer, as indicated above can be clear, i.e., transparent, translucent or opaque. But it is specifically contemplated that the polymer topcoat may have some color for the purposes of color correction, or for special effects. Thus, there can be incorporated into the polymer a dye that will impart color or tint. In addition, additives can be incorporated into the polymer that will give the overcoat various desired properties. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (AEROSOL OT), and alkylcarboxylate salts such as sodium decanoate.

The surface characteristics of the protective layer are in large part dependent upon the physical characteristics of the polymers which form the continuous phase and the presence or absence of solid, nonfusible particles. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the back surface of the element.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the water-dispersible polymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043, 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284, 294; (3) liquid paraffin and paraffin or wax like materials such as camauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No.308119, published December 1989, page 1006.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008. Preferably, a commercial embodiment involve simultaneous co-extrusion.

The laydown of the protective coating will depend on its field of application. For a photographic element, the laydown of the polyurethane-containing copolymer is suitably at least 0.54 g/m$^2$ (50 mg/ft$^2$), preferably 1.08 to 5.38 g/m$^2$ (100 to 500 mg/ft$^2$), most preferably 1.61 to 3.23 g/m$^2$ (150 to 300 mg/ft). It may be advantageous to increase the amount of polyvinyl alcohol in the overcoat as the laydown increases in order to improve the developability.

After applying the coating composition, during manufacture of the photographic element, it may be dried over a suitable period of time, for example 2 to 4 minutes. In the event of cracking, especially at lower levels of polyvinyl alcohol or when using an alternative film-forming polymer, it may be advantageous to adjust the temperature and/or humidity of the drying step to eliminate or reduce this cracking problem. Without wishing to be bound by theory, it is believed that higher levels of polyvinyl alcohol with limited degree of hydrolysis reduces the tendency of the polyvinyl alcohol to block the release of water during drying, which might otherwise occur with overly fast film formation and drying. Thus, polyvinyl alcohol according to one embodiment of the invention, by delaying film formation allows the release of water during drying which if blocked might otherwise adversely affect the uniformity of the overcoat.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure,* Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic imaging element as described in *Research Disclosure, Item* 34390, November 1992, or a transparent magnetic recording layer such as a layer containing magnetic particles on the underside of a transparent support as described in U.S. Pat. Nos. 4,279,945 and 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of processing a photographic element according to the present invention, the photographic element is developed in an alkaline developer solution having a pH greater than 7, preferably greater than 8, more preferably greater than 9. This allows the developer to penetrate the protective coating. After the pH is reduced, for example in a bleach fix solution, the protective coating becomes relatively water resistant. The addition of polyvinyl alcohol, according to one embodiment of the present invention, facilitates this method. It has been found the polyvinyl alcohol can provide improved wettability of the surface during processing and, at the same time, allows more of the polyvinyl alcohol to be washed out during the processing, so that the final product is more water resistant. Suitably at least 30%, preferably greater than 50%, more preferably greater than 75% of the original amount of PVA in the overcoat is washed out during processing of the exposed photographic element, such that the final product is depleted in hydrophilic water soluble polymer and hence relatively more water resistant. Although the processing-solution-permeable layer does not require fusing, optional fusing may improve the water resistance of the backside of the photographic element further This invention is particularly advantageous with respect to photographic prints due to superior physical properties including excellent resistance to water-based spills, fingerprinting, fading and yellowing, while providing exceptional transparency and toughness necessary for providing resistance to scratches, abrasion, blocking, and ferrotyping.

The present invention is illustrated by the following examples. Unless otherwise indicated, the molecular weights herein are weight average molecular weights, as determined by size exclusion chromotagraphy described below.

EXAMPLES

Characterization of Polymeric Materials

Glass Transition Temperture and Melting Temperature

Both glass transition temperature (Tg) and melting temperature (Tm) of the dry polymer material were determined by differential scanning calorimetry (DSC), using a ramping rate of 20° C./minute. Tg is defined herein as the inflection point of the glass transition and Tm is defined herein as the peak of the melting transition.

Polymer Preparation

P1 (Polyurethane Dispersion)

The same preparation scheme was used as for P3 except diethylene glycol was substituted for a portion of the 1,4-butanediol as chain extender, such that the monomer feed ratio on a weight basis was 33.0% polycarbonate polyol, 4.4% dimethylol propionic acid, 9.5% butanediol, 4.3% diethylene glycol and 48.9% isophorone diisocyanate. Tetrahydrofuran was removed by heating under vacuum to give an aqueous dispersion at 19.5% solids. Glass transition temperature was 55° C. as measured by DSC, and weight average molecular weight was 19,100.

P2 (Polyurethane-Acrylic Copolymer Dispersion)

Into a dry reactor was charged 96 grams of a diol (Millestert 9-55, MW2000 from Polyurethane Corporation of America), 87 grams of the methylene bis(4-cyclohexyl) isocyanate (Desmodur®W) and 0.02 grams of dibutyltin dilaurate (Aldrich). The mixture was held with stirring for 90 minutes at 94° C. under a blanket of argon after which 14 grams of dimethylol propionic acid was added to the reactor and the mixture stirred for 1.5 hours at 94° C. At this point 24 grams of methyl methacrylate were added and stirred for 1 hour at the same temperature. The resultant prepolymer was cooled to below 40° C., dissolved in a vinyl monomer mixture consisting of 113 grams of n-butyl acrylate, 188 grams of methyl methacrylate, and then treated with 11 grams of triethylamine and 2.5 grams of initator (AIBN). To this mixture was added 1000 ml deoxygenated water followed by 10 grams of ethylene diamine in 20 grams of water. The dispersion was heated to 65° C., held there with stirring for 2 hours and heated further to 80° C. for 10 hours. The resulting dispersion of the urethane acrylic copolymer had an acid number of 11.

P3 (Polyester Ionomer Dispersion)

AQ-55, a polyester ionomer dispersion, was used as-received from Eastman Chemical Co. The Tg of this material was 55° C.

P4 (NEOREZ A6092)

NEOREZ A6092 is an acrylic polymer made by Avecia, used as received.

P5 (NEOPAC R9699)

NEOPAC R9699 is a urethane-acrylic polymer made by Avecia, used as recieved.

Additional Materials (1) AIRVOL 203 poly(vinyl alcohol) (PVA) was obtained from Air Products which was 87 to 89% hydrolyzed (by hydrolyzed is meant that the acetate groups in the monomeric units are converted to hydroxy groups) and had a number-average molecular weight of 12,000 and a weight-average molecular weight of 35,000.

(2) CX-100®, a polyfunctional aziridine crosslinker for the polyurethane-acrylic copolymer dispersion, was obtained from Neo Resins (a division of Avecia).

(3) ACUSOL ASE-60 an alkali swellable polymer used as a thickener. Reflective layer materials Three different types of materials were coated as opacifiers in the white reflective layer: ROPAQUE OP96 is a hollow polymer (styrene/acrylic) sphere manufactured by Rohm and Haas. It has a particle size of 0.5$\mu$m. ROPAQUE HP-543 is a similar type of polymer bead with a particle size of 0.5 $\mu$m and a void volume of 43%. Titanium dioxide is a white pigment. All the three materials were coated with gelatin as a binder.

Photographic Sample Preparation

Samples was prepared by coating in sequence blue-light sensitive layer, interlayer, green-light sensitive layer, UV layer, red-light sensitive layer, UV layer and overcoat on photographic paper support. The components in each individual layer are described below.

Blue Sensitive Emulsion (Blue EM-1). A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1): A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 $\mu$m in edge length size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1): A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 $\mu$m in edgelength size. The emulsion is optimally sensitized by the addition of glutaryldiaminophenyldisulfide, sodium thiosulfate, tripotassium bis {2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |

-continued

| | | |
|---|---|---|
| | Diundecyl phthalate | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | Diundecyl phthalate | 10.40 |
| | ST-1 | 3.698 |
| | ST-3 | 26.39 |
| | Dye-2 | 0.678 |
| | 5-chloro-2-methyl-4-isothiazolin-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | Diundecyl phthalate | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | Tris(2-ethylhexyl)phosphate | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | Tris(2-ethylhexyl)phosphate | 7.404 |
| | 5-chloro-2-methyl-4-isothiazolin-3-one/2-methyl-4-isothiazolin-3-one(3/1) | 0.009 |
| Standard SOC | SOC | |
| | Gelatin | 60.0 |
| | SF-1 | 1.0 |
| | SF-2 | 0.39 |

BSD-4

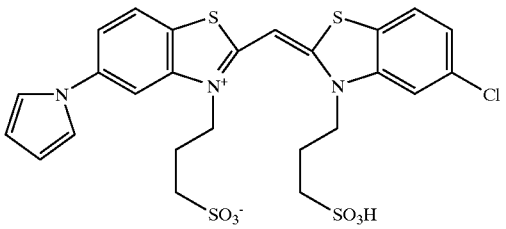

-continued
GSD-1
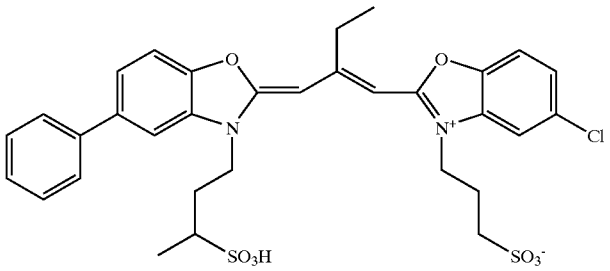
RSD-1
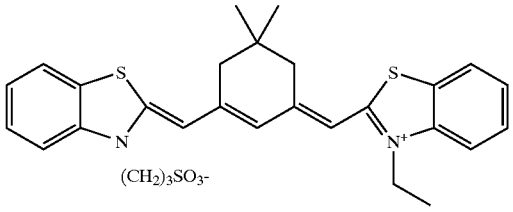
Y-4
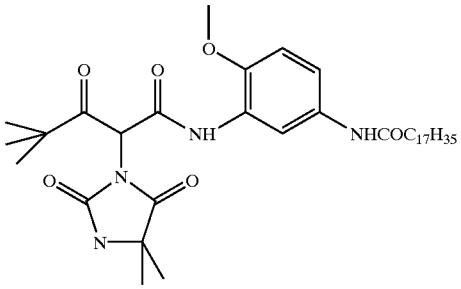
M-4
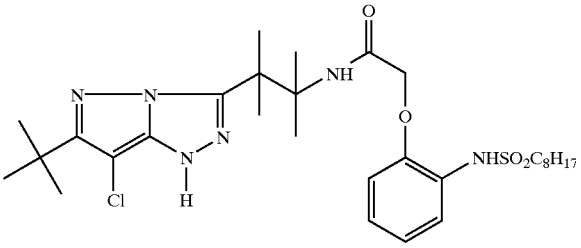
IC-35
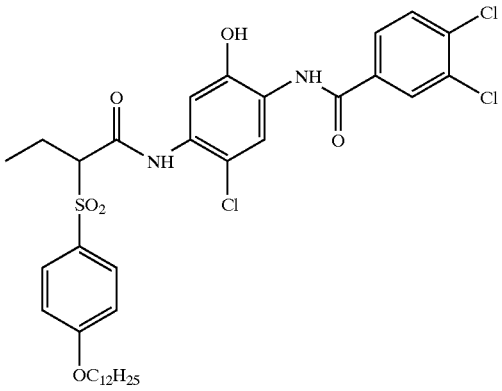

-continued
IC-36
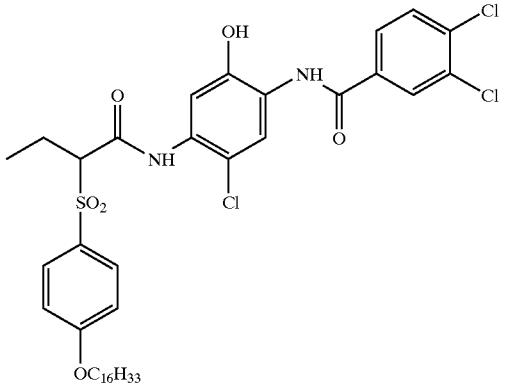
Dye-1
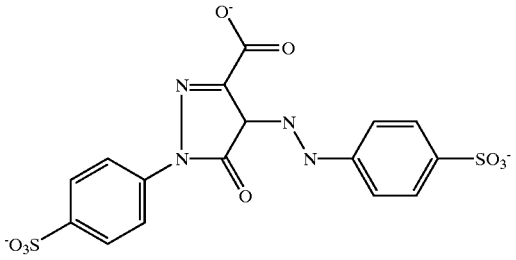
Dye-2
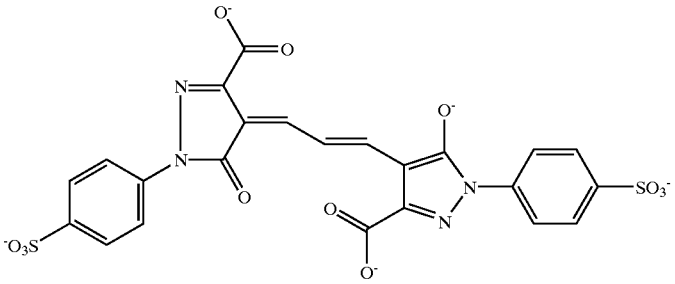
Dye-3
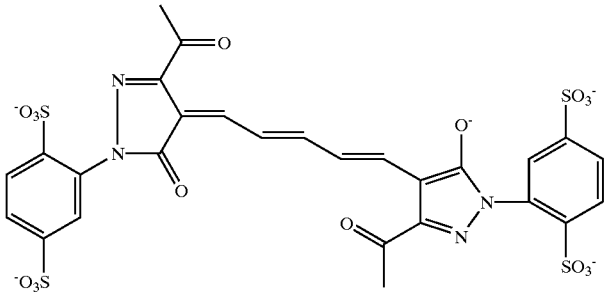
ST-1
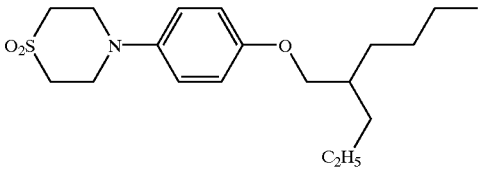
ST-3
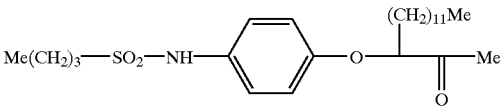

-continued
ST-4
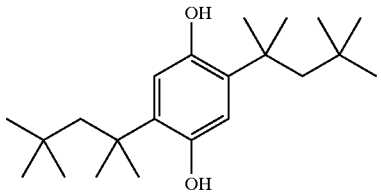
ST-16
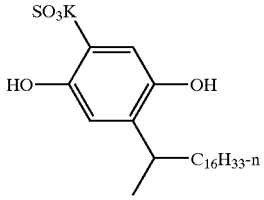
ST-23
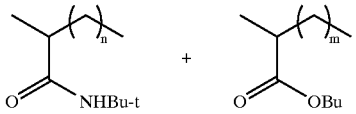
n:m = 1:1, MW = 75,000–100,000
ST-24
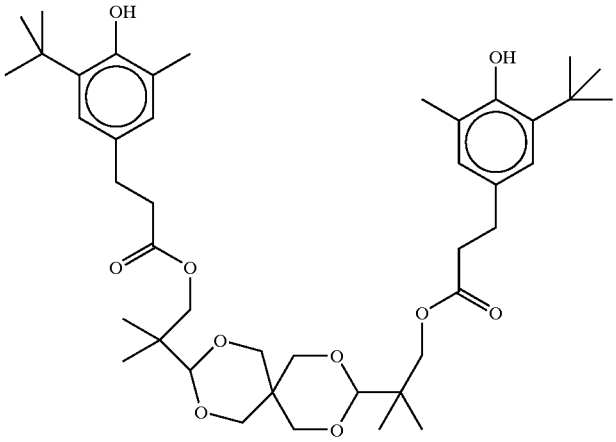
UV-1
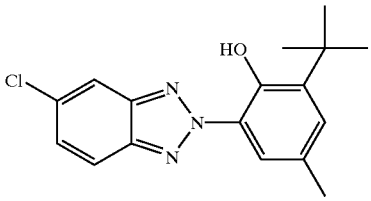
UV-2
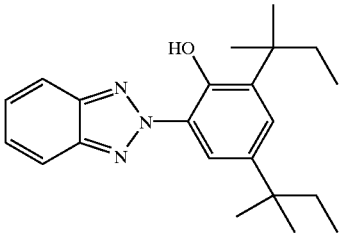

-continued

| | |
|---|---|
| SF-1 | 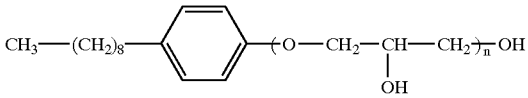 |
| SF-2 | $CF_3.(CF_2)_7.SO_3Na$ |

Example 1

This example illustrates an imaging element coated on transparent support with reflective layer and polymer overcoat in accordance with the present invention. Coating formulations were made at 15% ROPAQUE 10% gel. $TiO_2$ coating formulations were made at 20% $TiO_2$ 10% gel using a dispersion of 37% $TiO_2$ with 4.5% gelatin A simultaneous coating method was used. The polymer overcoats were coated over the white/reflective layer simultaneously with the 6 imaging layers described above. The entire coating was chill-set, dried and wound. The coatings were incubated at 70 F. and 50% RH for a week. They were subsequently processed in RA4 chemistry, prior to incubation and testing. All gelatin coatings contained BVSM crosslinker at a level of 2% with respect to the amount of gelatin. The gelatin containing layers consisted of the following layers starting from the layer closest to the support: 1)Blue sensitive layer, 2) Interlayer 3) green sensitive layer, 4) M/C interlayer, 5) red sensitive layer, 6) UV containing layer, and 7) white/reflective containing layer. All polymeric overcoats were coated with Polyvinyl alcohol AIRVOL203, made by Air Products. The PVA level was 35% with respect to the polymer. The support used in coatings OC-1 to OC-13 was PET with a thickness of 7/1000 of an inch. Coating OC-14 consisted of the six imaging layers with the polymer overcoat layer (P2), coated on a reflective paper support. OC-15 consisted of the six imaging layer with the gelatin SOC layer described above, coated on a reflective paper support.

TABLE 1

| Coating Number | White/Reflective Layer | Polymeric Overcoat (175 mg/ft2 w 35 mg PVA/ft2) |
|---|---|---|
| OC-1 | $TiO_2$, 300 mg/ft$^2$ (150 mg gel/ft$^2$) | P2 |
| OC-2 | $TiO_2$, 600 mg/ft$^2$ (300 mg gel/ft$^2$) | P2 |
| OC-3 | $TiO_2$, 600 mg/ft$^2$ (300 mg gel/ft$^2$) | P3 |
| OC-4 | $TiO_2$, 600 mg/ft$^2$ (300 mg gel/ft$^2$) | P1 |
| OC-5 | 250 mg OP-96 ROPAQUE/ft$^2$ (167 mg gel/ft$^2$) | P2 |
| OC-6 | 250 mg OP-96 ROPAQUE/ft2 (167 mg gel/ft$^2$) | P4 |
| OC-7 | 250 mg OP-96 ROPAQUE/ft$^2$ (167 mg gel/ft$^2$) | P4 |
| OC-8 | 250 mg HP-534-P ROPAQUE/ft$^2$ (167 mg gel/ft$^2$) | P2 |
| OC-9 | 250 mg HP-534-P ROPAQUE/ft$^2$ (167 mg gel/ft$^2$) | P4 |
| OC-10 | 1000 mg $TiO_2$/ft$^2$ (500 mg gel/ft$^2$) | P4 |
| OC-11 | 1000 mg $TiO_2$/ft$^2$ (500 mg gel/ft$^2$) | P5 |
| OC-12 | 1000 mg $TiO_2$/ft$^2$ (500 mg gel/ft2) | P3 |
| OC-13 | 1000 mg $TiO_2$/ft$^2$ (500 mg gel/ft2) | P2 |
| OC-14 | NONE, coated on paper support | P2 |
| OC-15 | None, coated on paper support | Gelatin SOC |

Processing Description

Since all coatings were done in white light processing was done using a developer solution devoid of color developing agent. This is done in order to result in Dmin processed coatings. The processing steps were as follows (all solutions at 40 C.).

1. 45 seconds in developer (without color developer)
2. 45 seconds in RA4 Bleach/Fix
3. 90–120 seconds water wash Drying was carried out after step 3 listed above: Four drying conditions were used:

1) Coatings are processed and dried in a cabinet at ~160° F.
2) Coatings were run through a dryer directly after the water wash (coatings are wet). The rollers pull the coating into the dryer through a convective section first and a radiant section second. The normal setup was 1 in/sec (residence time of about 5 sec). In condition 2, the radiant section was off and the convective section was set at 145° F.
3) The coatings were run through the same dryer with a setting of 185° F. convective with radiant section off
4) The coatings were run through the same dryer with a 185° F. setting on the convective section and the radiant section on at >400° F.

Stain Testing

Staining agents (primarily fruit punch) were applied to processed coatings. After ten minutes the staining agents were rinsed off and coatings allowed to dry. Dmin's and stain intensities were read with an Xrite-10® densitometer with status A filters (reflection). For all coatings, the staining agent was applied to the reverse of the print, i.e., on the polymer layer. Since staining behavior of the ESTAR polyester, via the viewing side, is similar for all coatings, we report data, for only one of the coatings, where the staining agent was applied on the viewing side. Stain intensities were calculated by subtracting Dmin from the stain density measurements.

TABLE 2

| Coating ID | Neutral Dmin as read through reflective layer (reverse side) | Neutral Dmin as read through ESTAR polyester (viewing side) |
|---|---|---|
| OC-1 | 0.11 | 0.13 |
| OC-2 | 0.1 | 0.12 |
| OC-3 | 0.1 | 0.12 |
| OC-4 | 0.1 | 0.12 |
| OC-5 | 0.12 | 0.14 |
| OC-6 | 0.17 | 0.14 |
| OC-7 | 0.11 | 0.14 |
| OC-8 | 0.12 | 0.14 |
| OC-9 | 0.12 | 0.14 |
| OC-10 | 0.08 | 0.12 |
| OC-11 | 0.08 | 0.12 |
| OC-12 | 0.08 | 0.13 |
| OC-13 | 0.08 | 0.12 |
| OC-13 W/O Processing (check) | 0.1 | 0.16 |
| OC-13 Stained on PET side | 0.08 | 0.12 |

TABLE 2-continued

| Coating ID | Neutral Dmin as read through reflective layer (reverse side) | Neutral Dmin as read through ESTAR polyester (viewing side) |
|---|---|---|
| OC-15 (check) | Not applicable, coated on paper with no white/ reflective layer | 0.12 |

As the data shows, the neutral Dmin through the viewing side, for the inventions is close to the Dmin of the conventional imaging element. Stain intensities (stain applied on reverse side) were calculated by subtracting Dmin from the stain density measurements.

TABLE 3

| Coating ID | Polymer | Drying conditions | Stain intensity through reflective layer (reverse side) | Stain intensity through ESTAR polyester (viewing side) |
|---|---|---|---|---|
| OC-1 | P2 | 1 | 0.19 | 0.18 |
| | | 2 | 0.18 | 0.24 |
| | | 3 | 0.19 | 0.26 |
| | | 4 | 0.03 | 0.02 |
| OC-2 | P2 | 1 | 0.16 | 0.25 |
| | | 2 | 0.15 | 0.26 |
| | | 3 | 0.17 | 0.27 |
| | | 4 | 0.02 | 0 |
| OC-3 | P3 | 1 | 0.04 | 0.06 |
| | | 2 | 0.02 | 0.02 |
| | | 3 | 0.01 | 0.01 |
| | | 4 | 0.01 | 0.01 |
| OC-4 | P1 | 1 | 0.02 | 0.03 |
| | | 2 | 0.01 | 0.01 |
| | | 3 | 0 | 0.01 |
| | | 4 | 0.03 | 0.03 |
| OC-5 | P2 | 1 | 0.3 | 0.44 |
| | | 2 | 0.29 | 0.58 |
| | | 3 | 0.27 | 0.39 |
| | | 4 | 0.14 | 0.3 |
| OC-6 | P4 | 1 | 0.29 | 0.45 |
| | | 2 | 0.3 | 0.62 |
| | | 3 | 0.13 | 0.33 |
| | | 4 | 0 | 0.15 |
| OC-7 | P4 | 1 | 0.24 | 0.41 |
| | | 2 | 0.28 | 0.52 |
| | | 3 | 0.02 | 0.18 |
| | | 4 | 0.01 | 0.16 |
| OC-8 | P2 | 1 | 0.31 | 0.4 |
| | | 2 | 0.29 | 0.6 |
| | | 3 | 0.28 | 0.57 |
| | | 4 | 0.11 | 0.26 |
| OC-9 | P4 | 1 | 0.31 | 0.5 |
| | | 2 | 0.31 | 0.66 |
| | | 3 | 0 | 0.15 |
| | | 4 | 0 | 0.16 |
| OC-10 | P4 | 1 | 0.19 | 0.37 |
| | | 2 | 0.21 | 0.41 |
| | | 3 | 0.16 | 0.32 |
| | | 4 | 0.01 | 0 |
| OC-11 | P5 | 1 | 0.21 | 0.42 |
| | | 2 | 0.22 | 0.36 |
| | | 3 | 0.2 | 0.38 |
| | | 4 | 0.06 | 0.06 |
| OC-12 | P3 | 1 | 0.05 | 0.09 |
| | | 2 | 0.06 | 0.12 |
| | | 3 | 0.01 | 0.02 |
| | | 4 | 0.01 | 0.01 |

TABLE 3-continued

| Coating ID | Polymer | Drying conditions | Stain intensity through reflective layer (reverse side) | Stain intensity through ESTAR polyester (viewing side) |
|---|---|---|---|---|
| OC-13 | P2 | 1 | 0.04 | 0.08 |
| | | 2 | 0.05 | 0.07 |
| | | 3 | 0 | 0 |
| | | 4 | 0 | 0 |

The presence of a polymeric layer furthest from the transparent support offers some level of stain protection. The degree of stain protection depends on the water permeability of the said polymer layer, which in turn is affected by the drying conditions after processing. When the drying conditions are fairly harsh, the polymer layer is rendered impermeable and the imaging element has excellent stain protection.

TABLE 4

| Coating ID | Polymer | Drying conditions | Stain density read through coated side | Stain density read through ESTAR side |
|---|---|---|---|---|
| OC-13 stained on ESTAR side | P2 | 1 | 0 | 0 |

The viewing side, which is through ESTAR polyester, is completely resistant to staining agents. The ESTAR polyester in combination with an impermeable polymer layer adjacent to the reflective layer and being the layer furthest from the polyester support, renders the entire imaging element stain resistant. Furthermore, the polyester, being relatively resilient to scratches, also makes the imaging element completely scratch resistant, particularly from the viewing side. Scratches on the polymer side are not viewable from the viewing side. Therefore, it is not crtical that the polymer layer be completely scratch resistant. The stain test was also carried out on an imaging element coated on ESTAR polyester where the back side has the reflective layer and the adjacent polymer layer has not been rendered impermeable (unprocessed). The staining agent was applied to the non-viewing side and the stain intensity was read from both sides.

TABLE 5

| Coating ID | Polymer | Drying conditions | Stain density read through coated side | Stain density read through ESTAR side |
|---|---|---|---|---|
| OC-13 unprocessed (permeable) | P2 | None | 0.18 | 0.37 |

As seen from the results, unless there is an impermeable layer furthest from the reflective support, the imaging element is not immune to staining agents. Thus, imaging elements coated on transparent support (as the viewing side), which do not have an impermeable layer furthest from the support (on the reverse side), which are disclosed in prior art, are not completely stain resistant. The stain test was also done on the same imaging element which was coated on a conventional reflective support, without a polymer layer. The staining agent was applied to the viewing (coated) side.

TABLE 6

| Coating ID | Polymer | Drying conditions | Stain intensity read from viewing side |
|---|---|---|---|
| OC-15 | none | 1 | 0.50 |

Conventional imaging elements coated on reflective support are not stain resistant. Prior art which disclose impermeable polymer overcoats for the same imaging elements, do offer some stain protection, but are prone to scratches on the viewing side. Furthermore, it can be concluded as follows: (1) Dmin and reflectivity similar to current photographic paper coatings can be achieved with coated white/reflective layers on a clear support; (2) A permeable coating (i.e., unprocessed polymeric overcoat with PVA intact) acts as a gelatin layer resulting in a stain position not unlike an unprotected print; (3) A non-permeable backing (coated side) can be achieved to protect the print, and heat treatment improves that protection; and (4) Staining does not occur on the PET support side of the print.

The invention has been described in detail with particular reference to certain preferred embodiments thereof, but it will be understood that variations and modifications can be effected within the spirit and scope of the invention.

What is claimed is:

1. A photographic element comprising, from front to back:

(a) a non-porous, water-impermeable transparent support having a thickness of at least 60 $\mu$m and a bending stiffness of 50 to 200 millinewtons;

(b) at least one silver-halide emulsion layer superposed on a side of said support; and (c) a reflective layer for effectively providing background opacity and whiteness for an image formed by the emulsion layer;

(d) overlying the reflective layer, a transparent or non-transparent processing-solution-permeable protective layer having a thickness of 0.5 to 10 $\mu$m and a dry laydown of at least 0.54 g/m$^2$ (50 mg/ft$^2$) made from a coating composition comprising 30 to 95%, by weight of solids, of water-dispersible polymer and 5 to 70%, by weight of solids, of water-soluble polymer such that more than 30 weight percent of water-soluble polymer is washed out during photographic processing; wherein the combined light reflectance of the reflective layer and the protective layer is greater than 80%.

2. The photographic element of claim 1 wherein the reflective layer comprises inorganic reflective particles.

3. The photographic element of claim 2 wherein said water-dispersible polymer comprises ionized or ionizable groups.

4. The photographic element of claim 1 wherein the reflective layer comprises voided polymer spheres.

5. The photographic element of claim 1 wherein the reflective layer comprises reflective particles in gelatin.

6. The photographic element of claim 1 wherein the transparent layer comprises a polyester, a cellulose ester, or a polycarbonate.

7. The photographic element of claim 1 wherein the thickness of the transparent support is 70 to 250 $\mu$m.

8. The photographic element of claim 1 wherein the coating composition comprises less than 5%, by weight of solids, of crosslinked gelatin and whereby the overcoat forms a water-resistant overcoat after photoprocessing.

9. The photographic element of claim 1 wherein said water-dispersible polymer is selected from the group consisting of polyesters, polyamides, polyurethanes, polyureas, polyethers, polycarbonates, polyacid anhydrides, urethane acrylic hybrid polymers derived from vinyl ethers, vinyl heterocylic compounds, styrenes, olefins, halogenated olefins, unsaturated acids and esters thereof, unsaturated nitriles, acrylamides and methacrylamides, and vinyl ketones, poly(epoxides) and copolymers formed from various combinations of the corresponding monomers, and combinations thereof.

10. The photographic element of claim 1 wherein said water-soluble polymer is selected from the group consisting of polyvinyl alcohol, cellulose ethers, poly(N-vinyl amides), polyacrylamides, polyesters, poly(ethylene oxide), dextrans, starch, noncrosslinked gelatin, whey, albumin, poly(acrylic acid), poly(ethyl oxazolines), alginates, gums, poly(methacrylic acid), poly(oxymethylene), poly(ethyleneimine), poly(ethylene glycol methacrylate), poly(hydroxy-ethyl methacrylate), poly(vinyl methyl ether), poly(styrene sulfonic acid), poly(ethylene sulfonic acid), poly(vinyl phosphoric acid) and poly(maleic acid), and combinations thereof.

11. The photographic element of claim 10 wherein said water-soluble polymer is polyvinyl alcohol.

12. The photographic element of claim 1 wherein said water-dispersible polymer is a polyurethane.

13. The photographic element of claim 12 wherein said polyurethane comprises an interpenetrating or semi-interpenetrating network of a vinyl polymer and a polyurethane.

14. The photographic element of claim 1 wherein the protective layer further comprises one or more additives selected from the group consisting of surfactants, emulsifiers, coating aids, lubricants, matte particles, rheology modifiers, crosslinking agents, antifoggants, inorganic fillers, pigments, magnetic particles and/or biocides, and reflective particles.

15. The photographic element of claim 1 wherein the transparent support further comprises UV absorber.

16. The photographic element of claim 1 wherein the transparent support has an embossed pattern to change the gloss or appearance of the surface.

17. A method of making a photographic print comprising:

(a) image-wise exposing the photographic element of claim 1 to light radiation;

(b) developing the image-wise exposed photographic element in a developer solution having a pH greater than 7 to obtain the photographic print; and (c) drying the photographic element to a temperature above 60° C. to render the overcoat water-resistant in the final product.

18. A photographic element comprising, from front to back:

(a) a non-porous, water-impermeable transparent support having a thickness of 60 to 250 $\mu$m and bending stiffness from 50 to 250 millinewtons;

(b) at least one silver-halide emulsion layer superposed on a side of said support; and (c) a non-gelatin containing processing-solution permeable reflective layer having a laydown of at least 0.54 g/m$^2$ (50 mg/ft$^2$) made from a coating composition comprising 30 to 95%, by weight of solids, of water-dispersible polymer in the form of particles having an average particle size of less than 10 $\mu$m and a $T_g$ between −40° C. and 80° C., and 5 to 70%, by weight of solids, of water-soluble polymer such that more than 30 weight percent of water-soluble polymer is washed out during photographic processing, further comprising reflective particles dispersed in the layer to provide background opacity and whiteness for an image formed by the emulsion layer.

* * * * *